US008605408B2

(12) United States Patent
Godo et al.

(10) Patent No.: US 8,605,408 B2
(45) Date of Patent: Dec. 10, 2013

(54) POWER SEMICONDUCTOR DEVICE FOR IGNITER

(75) Inventors: Shinsuke Godo, Tokyo (JP); Yukio Yasuda, Tokyo (JP); Atsunobu Kawamoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 434 days.

(21) Appl. No.: 12/877,435

(22) Filed: Sep. 8, 2010

(65) Prior Publication Data

US 2011/0141640 A1 Jun. 16, 2011

(30) Foreign Application Priority Data

Dec. 15, 2009 (JP) ..... 2009-284098

(51) Int. Cl.
*F23Q 3/00* (2006.01)

(52) U.S. Cl.
USPC ..... 361/253

(58) Field of Classification Search
USPC ..... 361/253
See application file for complete search history.

(56) References Cited

U.S. PATENT DOCUMENTS

| | | | | |
|---|---|---|---|---|
| 4,670,705 | A * | 6/1987 | Sievers et al. | 322/28 |
| 5,631,494 | A * | 5/1997 | Sakurai et al. | 257/572 |
| 6,218,709 | B1 | 4/2001 | Yasuda | |
| 7,341,052 | B2 * | 3/2008 | Kawakita | 123/647 |
| 2004/0027757 | A1 * | 2/2004 | Minatani | 361/91.1 |
| 2005/0061306 | A1 | 3/2005 | Naruse et al. | |
| 2008/0100147 | A1 * | 5/2008 | Yasuda et al. | 307/140 |

FOREIGN PATENT DOCUMENTS

| | | | |
|---|---|---|---|
| CN | 101174619 | A | 5/2008 |
| DE | 35 26 218 | A1 | 2/1987 |
| DE | 10 2004 019 319 | A1 | 5/2005 |
| EP | 1 201 920 | A2 | 5/2002 |
| JP | 5-259853 | | 10/1993 |
| JP | 7-86587 | | 3/1995 |
| JP | 2000-183341 | | 6/2000 |
| JP | 2009-191621 | A | 8/2009 |

OTHER PUBLICATIONS

Combined Chinese Office Action and Search Report Issued Oct. 10, 2012 in Patent Application No. 201010609297.3 (with English translation and English translation of Categories of Cited Documents).

(Continued)

*Primary Examiner* — Rexford Barnie
*Assistant Examiner* — Ann Hoang
(74) *Attorney, Agent, or Firm* — Oblon, Spivak, McClelland, Maier & Neustadt, L.L.P.

(57) ABSTRACT

A power semiconductor device for an igniter comprises: a first semiconductor switching device; and an integrated circuit, wherein the integrated circuit includes: a second semiconductor switching device connected in parallel with the first semiconductor switching device and having a smaller current capacity than a current capacity of the first semiconductor switching device; a delay circuit delaying a control input signal so that the second semiconductor switching device is energized prior to the first semiconductor switching device; a third semiconductor switching device including a thyristor structure connected to a high voltage side main terminal of the second semiconductor switching device and being made conductive by a part of a main current flowing through the energized second semiconductor switching device; and a first excess voltage detection circuit stopping the first semiconductor switching device when voltage on the high voltage side main terminal is equal to or more than a predetermined voltage.

4 Claims, 16 Drawing Sheets

(56) References Cited

OTHER PUBLICATIONS

U.S. Appl. No. 12/877,348, filed Sep. 8, 2010, Godo, et al.
U.S. Appl. No. 12/877,538, filed Sep. 8, 2010, Godo, et al.
Office Action issued May 24, 2013, in German Patent Application No. 10 2010 042 583.4 with English translation.
Combined Office Action & Search Report issued Mar. 18, 2013 in Chinese Application No. 201010609297.3 (With Partial English Translation).

* cited by examiner

POWER SEMICONDUCTOR DEVICE FOR IGNITER

BACKGROUND OF THE INVENTION

1. Field of the Invention

The present invention relates to a power semiconductor device for an igniter having an overheat protection function to protect a semiconductor switching device at an abnormally high temperature in an ignition system for an internal combustion engine.

2. Background Art

An ignition system for an internal combustion engine such as an automobile engine has, as components for generating a high voltage to be applied to an ignition plug, and a power semiconductor device incorporating an ignition coil (inductive load), a semiconductor switching device for driving the ignition coil and a circuit device (semiconductor integrated circuit) for controlling the semiconductor switching device. These components constitute a so-called igniter. The ignition system also has an engine control unit (ECU) including a computer. In such a power semiconductor device for an igniter, the resistance to a load dump surge, i.e., a transient excess voltage surge generated in the power supply voltage, is ordinarily assured as one of items of reliability of the power semiconductor device. In ordinary cases, therefore, a method is used in which the power supply voltage is directly observed and the operation of a semiconductor switching device or an integrated circuit controlling the semiconductor switching device installed in the power semiconductor device is stopped when the power supply voltage is excessively high to protect the integrated circuit.

Electric power for the above-described power semiconductor device for an igniter is ordinarily supplied from a motor vehicle battery. However, fluctuations and surge voltages in the voltage of such a power supply are large. In most cases, therefore, the power supply voltage is clamped with a Zener diode, then regulated in a constant-voltage circuit and supplied into the integrated circuit. Direct observation of the battery voltage requires adding a special signal taking-in terminal and providing a protective device of a large power capacity at the terminal. This means an inevitable increase in manufacturing cost. Further, since the Zener diode is provided on the terminal through which the battery voltage is input for power supply to the integrated circuit, the voltage is fixed substantially at the Zener clamp voltage and the desired sensitivity cannot be obtained with respect to an excess voltage. Thus, the above-described voltage observation method is not suitable for high-accuracy voltage detection.

As a solution to the above-described problem, a technique to protect the above-described switching device by monitoring the current between main terminals of the semiconductor switching device and limiting the control terminal voltage on the semiconductor switching device when the current flowing becomes equal to or larger than a predetermined value has been devised (see, for example, Japanese Patent Laid-Open Nos. 5-259853 and 7-86587).

A technique including forming a thyristor on the substrate on which the switching device is formed to extract a high-potential-side main terminal voltage on the semiconductor switching device when the switching device is off and indirectly monitoring the power supply voltage from the output from the thyristor is also disclosed (see, for example, Japanese Patent Laid-Open No. 2000-183341).

SUMMARY OF THE INVENTION

The known techniques in the art are unsatisfactory in some respects from the viewpoint of protection from a transient excess voltage of the power supply. That is, according to Japanese Patent Laid-Open Nos. 5-259853 and 7-86587, only limiting of the current value between the main terminals is performed if the current flowing between the main terminals is larger than it is during the ordinary operation of the semiconductor switching device in the on-state when the semiconductor switching device is turned on in a state where the power supply voltage is increased. When current limiting is performed in this way, the semiconductor switching device is on while the current therethrough is being limited, and the voltage corresponding to the increase in the power supply voltage is almost entirely applied between the main terminals, thereby causing a large Joule loss. This Joule loss is entirely a power consumption in the form of heat. Thus, the known techniques have the problem of an increase in power consumption. Also, measures such as preparation of a large-scale heat dissipation mechanism for improvement in heat dissipation and selection of a device having a high short-circuit capability as the above-described semiconductor switching device are necessarily taken. There is, therefore, a problem of difficulty in pursuing the reduction in size and the simplification of the above-described power semiconductor device for an igniter.

In the technique according to Japanese Patent Laid-Open No. 2000-183341, the thyristor for monitoring the voltage on the high-potential-side main terminal is mounted on the substrate of the semiconductor switching device that causes the primary current to flow through the ignition coil or shuts off the primary current. In monitoring the main terminal voltage, a trigger signal for turning on the thyristor is required. For supply of the trigger signal, additional components such as a bias source and resistance elements are required. Wiring is also required for connection between the thyristor formed on the semiconductor switching device and the integrated circuit that performs control. The necessity of these components is also a hindrance to reducing in size and simplifying the power semiconductor devices for an igniter.

In view of the above-described problems, an object of the present invention is to provide a highly reliable power semiconductor device for an igniter capable of realizing protection from an excess voltage of a power supply with a simple configuration without causing any hindrance to reducing in size and simplifying the entire unit.

According to the present invention, a power semiconductor device for an igniter comprises: a first semiconductor switching device causing a current to flow through a primary side of an ignition coil or shutting off the current flowing through the primary side of the ignition coil; and an integrated circuit driving and controlling the first semiconductor switching device, wherein the integrated circuit includes: a second semiconductor switching device connected in parallel with the first semiconductor switching device and having a smaller current capacity than a current capacity of the first semiconductor switching device; a delay circuit delaying a control input signal for driving the first and second semiconductor switching devices so that the second semiconductor switching device is energized prior to the first semiconductor switching device; a third semiconductor switching device including a thyristor structure having a main terminal connected to a high voltage side main terminal of the second semiconductor switching device, the thyristor structure being made conductive by a part of a main current flowing through the energized second semiconductor switching device; and a first excess voltage detection circuit monitoring voltage on the high voltage side main terminal of the second semiconductor switching device by monitoring conduction of the third semiconductor switching device and stopping the first semiconductor switching device when the voltage is equal to or more than predetermined voltage.

In the power semiconductor device for an igniter according to the present invention, the second semiconductor switching device mounted in the integrated circuit is energized prior to the first semiconductor switching device for causing to flow and shutting off the primary current through the ignition coil, thereby detecting the generation of an excess voltage in the power supply before switching-on of the first semiconductor switching device, and enabling prevention of this switching-on. Thus, the occurrence of wasted Joule loss is prevented. Also, because the third semiconductor switching device is made conductive by energization of the second semiconductor switching device mounted in the integrated circuit, there is no need to separately provide a bias source or the like. Further, an interface between the components of the integrated circuit and a control circuit in the same integrated circuit can be easily implemented.

Other and further objects, features and advantages of the invention will appear more fully from the following description.

DETAILED DESCRIPTION OF THE PREFERRED EMBODIMENTS

First Embodiment

Figure 1A:
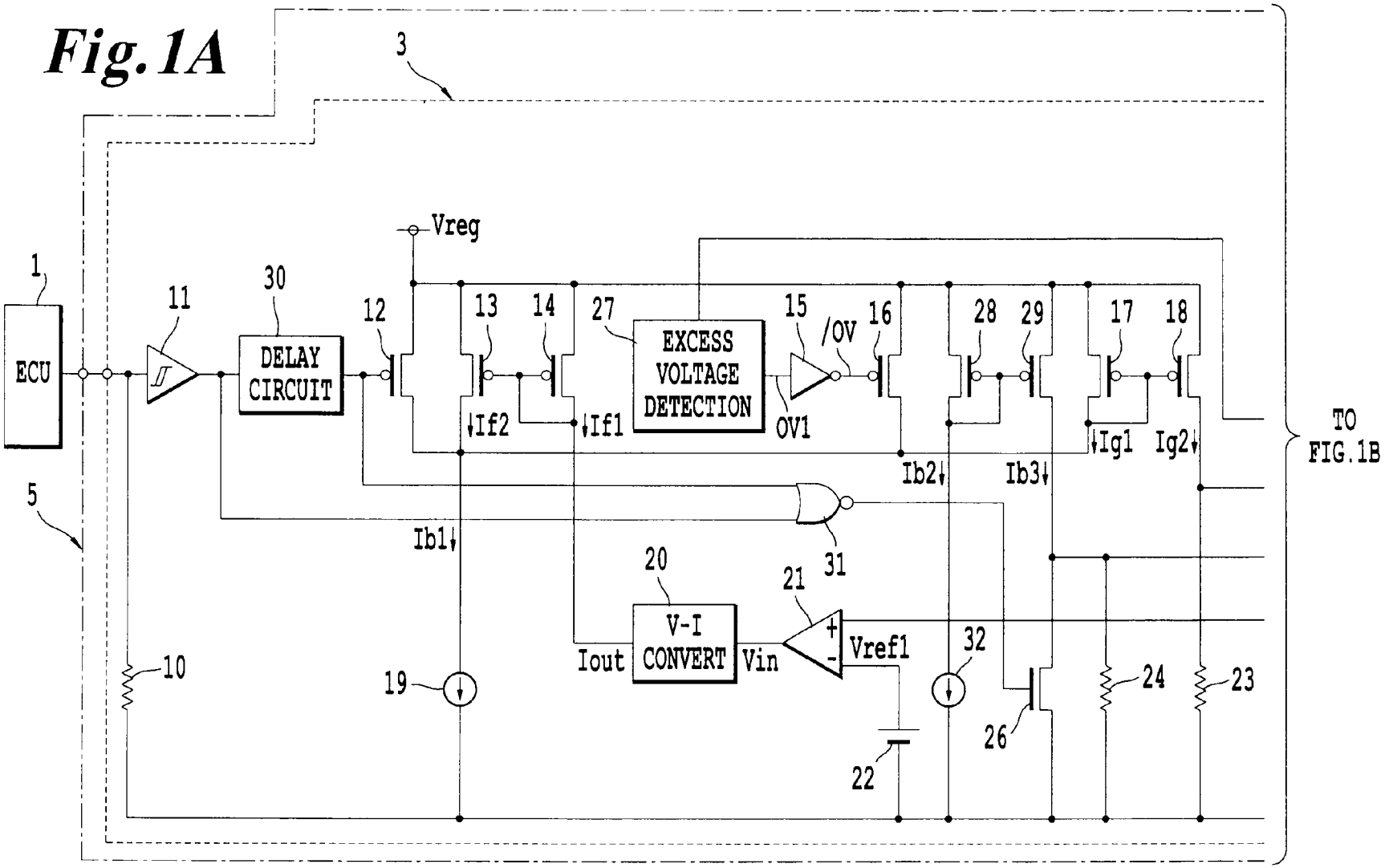
FIG. 1 is a circuit diagram showing an ignition system according to a first embodiment of the present invention.
Figure 1B:
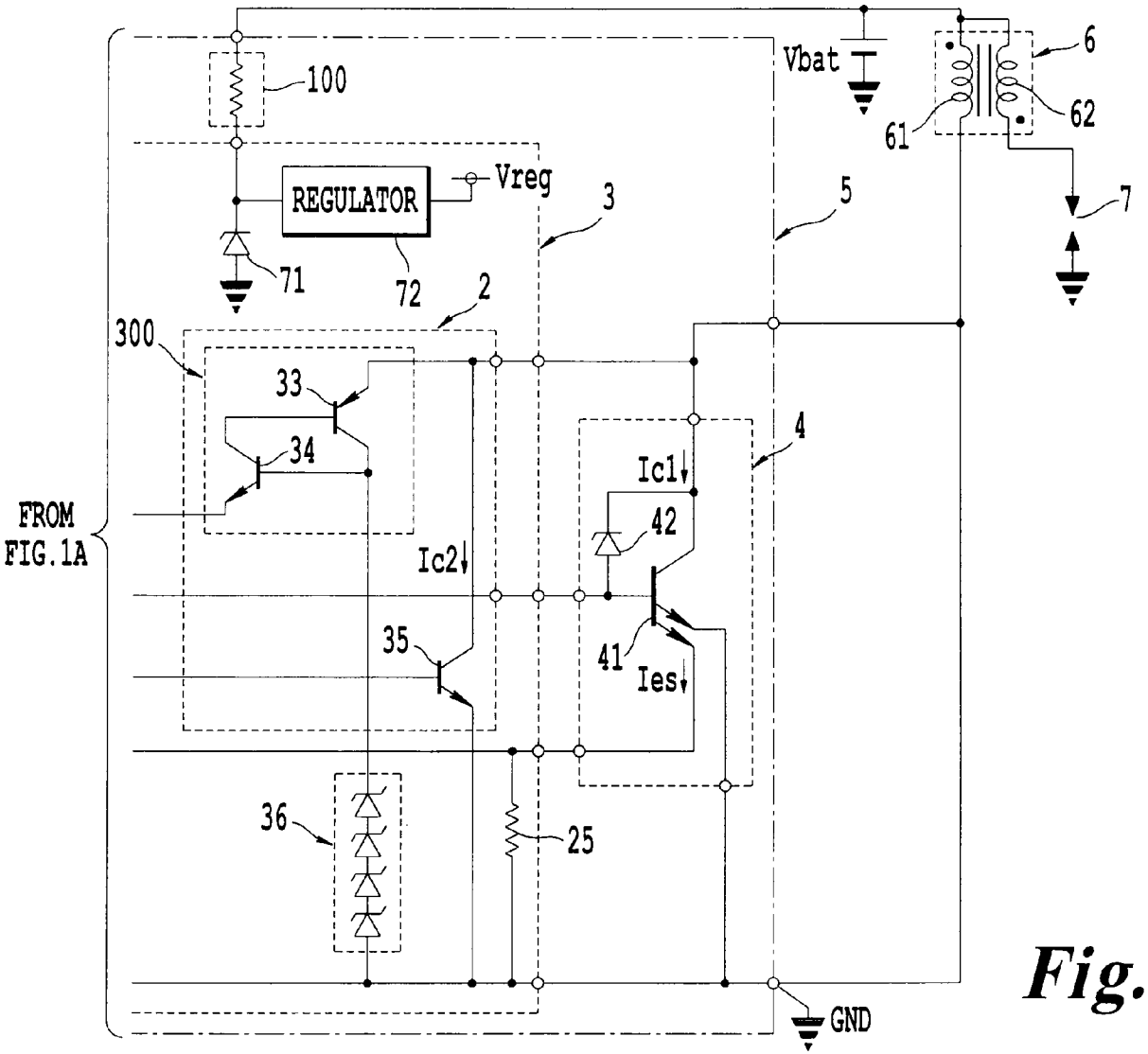

FIG. 1 shows an embodiment of an ignition system according to the present invention. In the ignition system shown in FIG. 1, a power supply Vbat such as a battery is connected to one end of a primary coil 61 in an ignition coil 6, while a power semiconductor device 5 for an igniter (hereinafter referred to as "an igniter power semiconductor device") is connected to the other end of the primary coil 61. The power supply Vbat is also connected to one end of a secondary coil 62, and an ignition plug 7 having one end grounded is connected to the other end of the secondary coil 62. An ECU 1 outputs a control input signal for driving a semiconductor switching device 41 to the igniter power semiconductor device 5.

In this ignition system, the igniter power semiconductor device 5 has a first semiconductor switching device 4 including a main insulated gate bipolar transistor (main IGBT) 41 for causing a current to flow through the primary coil 61 or shutting off the current flowing through the primary coil 61, and an integrated circuit 3 for driving and controlling the main IGBT 41 according to the control input signal from the ECU 1 and other operating conditions.

As the main IGBT 41, which is a main component of the first semiconductor switching device 4, an IGBT having, in addition to the ordinary electrode terminals, i.e., the collector, emitter and gate, a sense emitter for sensing the collector current Ic, through which a current proportional to (for example, about 1/1000 of) the collector current flows, is adopted. Also, a Zener diode 42 provided for protection against a surge voltage is connected between the collector and the gate in the reverse direction.

In the integrated circuit 3, collector voltage detection means 2 including a sub IGBT 35 as a second semiconductor switching device and a thyristor structure device 300 provided as a third switching device and constituted by a pnp transistor 33 and an npn transistor 34 is monolithically integrated. The collector terminal of the sub IGBT 35 and the emitter terminal of the pnp transistor 33 corresponding to one of two main terminals of the thyristor structure device 300 are connected to the collector terminal of the main IGBT 41.

Further, clamp means 36 formed by connecting Zener diodes in series is connected to a point of connection between the base terminal of the npn transistor 34 and the collector terminal of the pnp transistor 33 constituting the thyristor structure device 300. The maximum of an output voltage on the emitter terminal of the npn transistor 34 corresponding to the other main terminal of the thyristor structure device 300 is thereby limited to (the clamp voltage of the clamp means 36)−(voltage Vbe of the npn transistor 34).

Figure 2:
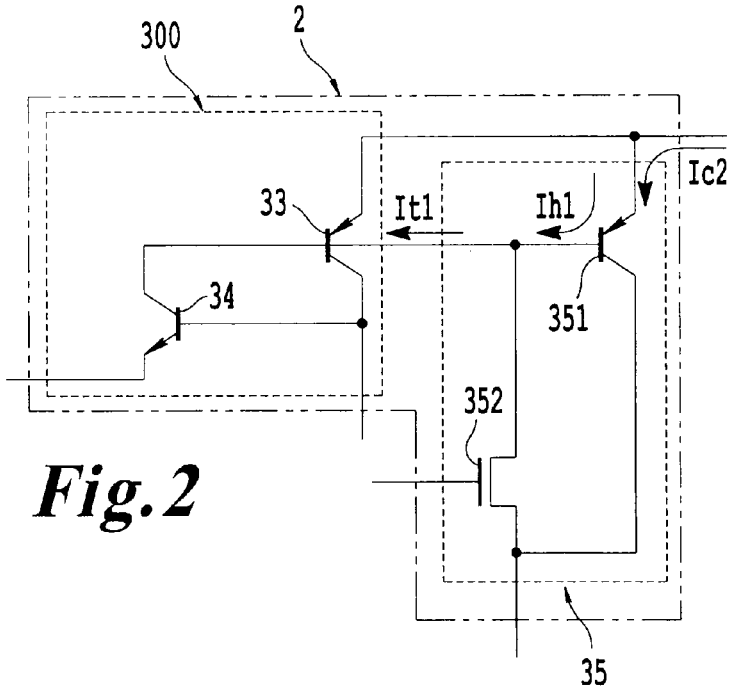
FIG. 2 shows an equivalent circuit of collector voltage detection means according to the first embodiment of the present invention.

The configuration of the collector voltage detection means 2 will be described in detail with reference to FIGS. 2 and 3. In FIG. 2, the sub IGBT 35 is equivalently expressed as an Nch MOS transistor 352 and a pnp transistor 351 driven by the Nch MOS transistor 352.

Figure 3:
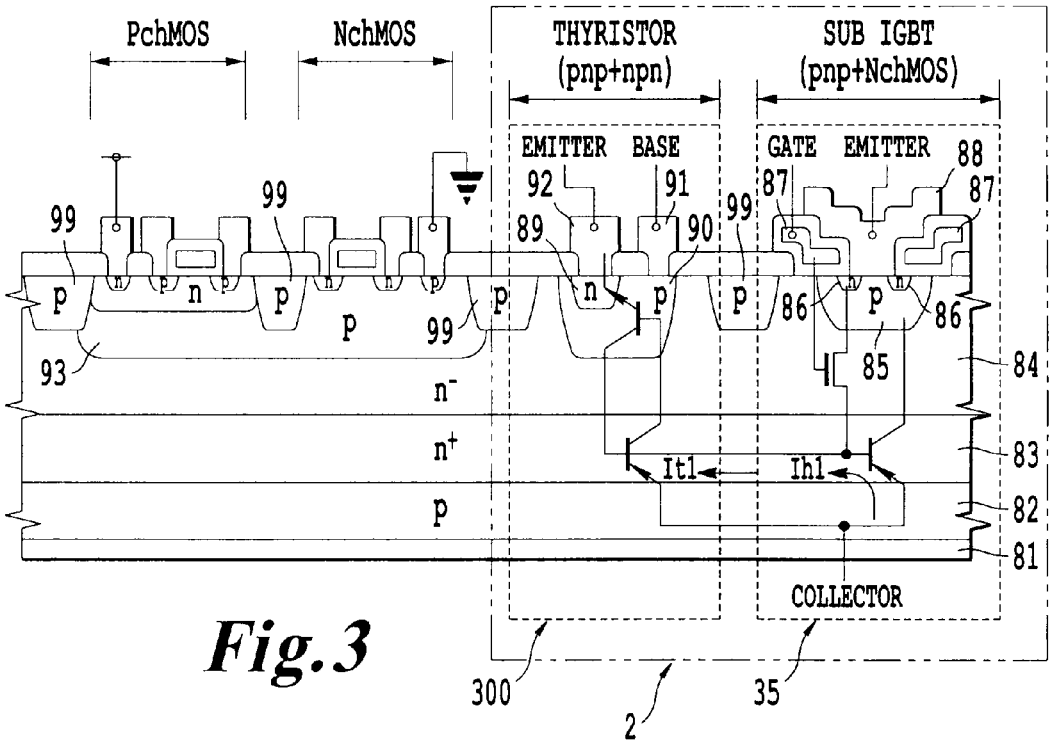
FIG. 3 is a sectional view showing an integrated circuit according to a first embodiment of the present invention.

Referring to a longitudinal sectional view of the structure of the integrated circuit 3 shown in FIG. 3, an n+ epi region 83 and an n− epi region 84 are formed on a p-type substrate 82. In the n− epi region 84, a p-type region 85 is formed and an n-type region 86 is formed in the p-type region 85. A gate electrode 87 formed of polysilicon or the like and insulated by a gate oxide film is formed on the n-type region 86. Further, an aluminum wiring element 88 serving as the emitter terminal electrode of the sub IGBT 35 is formed. The sub IGBT 35 is thus formed in the integrated circuit 3.

Further, referring to FIG. 3, the thyristor structure device 300 is formed in the vicinity of the sub IGBT 35, with a p-type region 99 interposed therebetween as a separation region. That is, a p-type region 90 is formed in the n− epi region 84, and an n-type region 89 is formed in this p-type region 90. Aluminum wiring elements 91 and 92 are formed to enable potentials on the p-type region 90 and the n-type region 89 to be taken out through the base terminal and the emitter terminal, respectively. Thus, the thyristor structure device 300 having a pnpn structure as seen from the back surface side is formed monolithically with the sub IGBT 35.

Further, referring to FIG. 3, a p-type island region 93 is formed on the n− epi region 84, with a p-type region interposed as a separation region between the p-type island region 93 and the thyristor structure device 300. An Nch MOS, a Pch MOS and other components constituting a control circuit portion are also formed monolithically on the p-type island region 93. The p-type island layer 93 is connected to a reference power supply potential GND, i.e., the lowest potential in the integrated circuit 3, thereby being electrically isolated from the collector voltage detection means 2. Therefore there is no interference between the control circuit portion and the collector voltage detection means 2.

A back-surface metallized layer 81 and the p-type substrate 82 are used in common between one of the two main terminals of the thyristor structure device 300 and the collector electrode of the sub IGBT 35. By mounting on a conductor frame (not shown) on which the main IGBT 41 is mounted, the one main terminal of the thyristor structure device 300 and the collector electrode of the sub IGBT 35 are electrically connected to the collector electrode of the main IGBT 41 without any additional wiring.

The operation of the sub IGBT 35 and the thyristor structure device 300 will be described with reference to FIGS. 2 and 3. When a voltage is applied to the gate electrode 87, the Nch MOS 352 is turned on and electrons are injected from the emitter electrode 88. When the injected electrons arrive at the n-region 84 and the n+ region 83, the electrical neutrality condition is satisfied and, therefore, positive holes, which are minority carriers, are injected from the back surface. Part of a positive hole current Ih1 formed by the injected positive holes forms a base current It1 in the pnp transistor 33 constituting the thyristor structure device 300 monolithically formed, thereby triggering and turning on the thyristor structure device 300 to provide conduction at a low impedance between the one main terminal (the back-surface metallized electrode 81) and the other main terminal (the emitter electrode 92).

Figure 4:
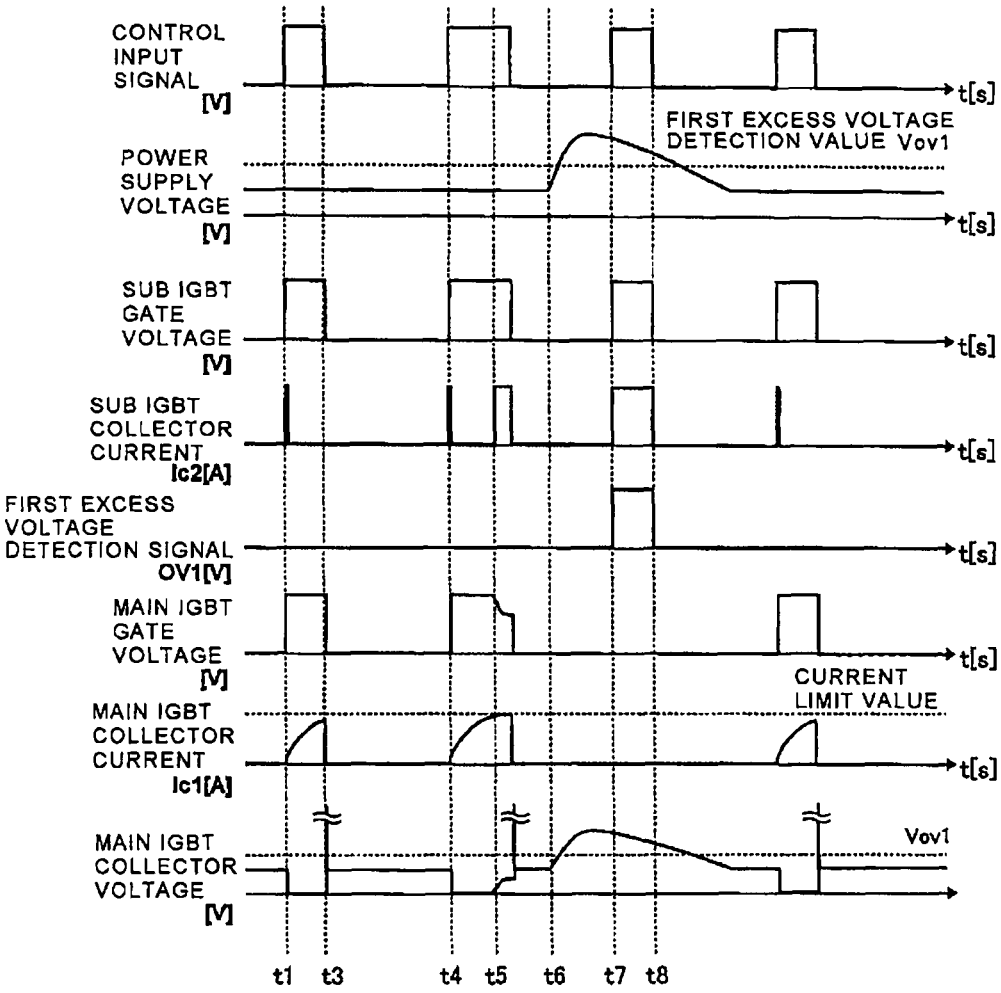
FIG. 4 is a timing chart for illustrating the operation of the ignition system according to the first embodiment of the present invention.
Figure 5:
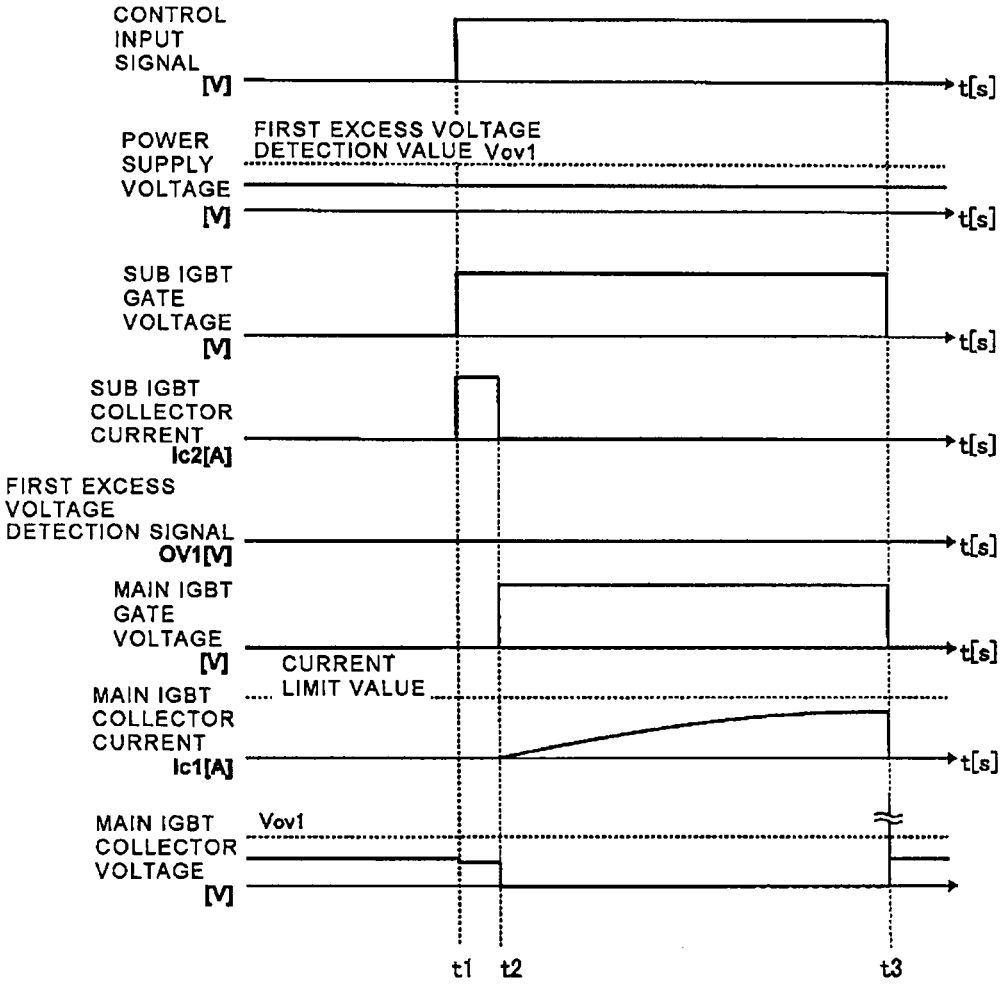
FIG. 5 is an enlarged view of a part of FIG. 4.

The functions of the integrated circuit 3 and the ignition operation of the entire ignition system will be described with reference to the timing chart of FIGS. 4 and 5.

The normal operation will first be described. A high-level control input signal applied at time t1 from the ECU 1 to an input terminal of the integrated circuit 3 undergoes waveform shaping in a Schmitt trigger circuit 11 and thereafter diverges into two lines, one of which is connected via a delay circuit 30 to the gate terminal of a first Pch MOS 12 for driving the main IGBT 41 and to an input terminal of a first NOR circuit 31, and the other of which is connected to the other input terminal of the first NOR circuit 31.

By an output from the first NOR circuit 31, a first Nch MOS 26 is turned off. An output current Ib2 from a first constant-current source 32 is thereby input to a first current mirror circuit constituted by a second Pch MOS 28 and a third Pch MOS 29 to cause an output current Ib3 according to the mirror ratio to flow through a first resistor 24. A gate drive voltage to the sub IGBT 35 is thereby generated to turn on the sub IGBT 35.

The delay circuit 30 is arranged to delay only a rise of the input signal. That is, during a time period from time t1 to time t2 (specifically, about several ten microseconds), the output from the delay circuit 30 is low level and the first Pch MOS 12 is on. Accordingly, the main IGBT 41 is maintained in the off-state.

By turning on the sub IGBT 35 as described above in the description of the operation, the thyristor structure device 300 is made conductive. The current capacity of the sub IGBT 35 is set smaller than that of the main IGBT 41. More specifically, the transistor size is set so that the transistor saturates at about 100 mA. The winding resistance of the primary coil 61 in the ignition coil 6, i.e., the load, is about 0.4 to 0.5Ω, and the voltage drop across the coil is about several ten millivolts even when the sub IGBT 35 is on. Therefore the collector potential is maintained approximately equal to the power supply voltage.

Accordingly, the voltage on the other main terminal of the thyristor structure device 300 is (the collector potential)−(voltage Vsat of the pnp transistor 33)−(voltage Vbe of the npn transistor 34). The second and third terms in the above expression are generally constant, about 0.2 V and 0.7 V, respectively. It is, therefore, possible to observe the voltage corresponding to the power supply voltage by monitoring the voltage on the other main terminal of the thyristor structure device 300 with first excess voltage detection circuit 27. During the normal operation, the power supply voltage is lower than any voltage determined as an excess voltage and the first excess voltage detection circuit 27 outputs a low level as a first excess voltage detection signal OV1 designating the normal state.

The operation when the output from the delay circuit 30 becomes high level at time t2 will be described. The output from the first NOR circuit 31 is maintained at low level. Accordingly, the first Nch MOS 26 is in the off-state and the gate voltage to the sub IGBT 35 is generated at this time.

On the other hand, the first Pch MOS 12 is turned off. The first excess voltage detection signal OV1 is low level, while an inverted excess voltage detection signal/OV output through a first NOT circuit 15 is high level. (While an inverted signal is ordinarily expressed by adding an overbar on a symbol for the original signal, an alternative expression is made by adding a slash before a symbol for the original signal in this specification.) By the inverted excess voltage detection signal/OV, a fourth Pch MOS 16 is also turned off.

A second current mirror circuit constituted by a fifth Pch MOS 17 and a sixth Pch MOS 18 is thereby started to operate.

A reference-side current value Ig1 of the second current mirror circuit is equal to the result of subtraction of an output current value If2 of a current-limiting circuit described below from an output current value Ib1 of a second constant-current source 19. With respect to this reference-side current Ig1, a current Ig2 according to the mirror ratio of the second current mirror circuit is produced as an output current.

By the flow through second resistor 23 of the output current Ig2 from the second current mirror circuit, the gate drive voltage to the main IGBT 41 is generated to cause the main IGBT 41 to operate by becoming on. At this time, a main IGBT collector current Ic1 such as shown in FIGS. 4 and 5 flows through the primary coil 61 and the main IGBT 41 according to a time constant determined by the inductance and the wiring resistance of the primary coil 61.

At this time, the collector terminal voltage on the main IGBT 41 is approximately zero. Accordingly, a sub IGBT collector current Ic2 through the sub IGBT 35 connected to the collector terminal is approximately zero. Similarly, the thyristor structure device 300 is turned off to be nonconductive between the main terminals. That is, in the normal operation, the collector voltage detection means 2 is effective only during the delay period determined by the delay circuit 30. Therefore, the power consumption of the entire integrated circuit 3 is not increased.

A low-level control input signal is applied from the ECU 1 at time t3. The first Pch MOS 12 is thereby turned on to stop the first current mirror circuit. Charge accumulated on the gate of the main IGBT 41 is discharged in an extremely short time period through the second resistor 23, so that the main IGBT 41 is rapidly shut off.

At this time, a high voltage of about 500 V is generated on the collector terminal of the main IGBT 41 by the primary coil 61 in the direction to maintain the current that has been flowing. This voltage is boosted to about 30 kV according to the winding ratio of the ignition coil 6 to cause the ignition plug 7 connected to the secondary coil 62 to spark.

A case where the high-level control input signal is applied from the ECU 1 for a comparatively long energization time period from time t4 will be described with reference to FIG. 4.

By the application of the high-level control input signal from the ECU 1, the main IGBT collector current Ic1 is gradually increased from time t4 in the way described above. However, a current limit value for inhibiting the main IGBT collector current Ic1 from becoming equal to or higher than a predetermined constant value is set for the purpose of preventing melting of the winding of the ignition coil 6 and magnetic saturation of the transformer.

Limiting of the main IGBT collector current Ic1 is realized by a mechanism described below. A sense current Ies from the main IGBT 41 flows through a third resistor 25 in the integrated circuit 3 to generate a voltage across the third resistor 25 according to the main IGBT collector current Ic1. This voltage is compared with a voltage Vref1 of a first reference voltage source 22 by an amplifier 21. A V-I conversion circuit 20 outputs a current If1 according to the difference between the compared values. From this current If1, a third current mirror circuit constituted by a seventh Pch MOS 13 and an eighth Pch MOS 14 produces an output current according to its mirror ratio. This output current is output as a current-limiting signal If2. The current-limiting signal If2 acts in the direction to reduce the current Ig2 from which the gate drive voltage to the main IGBT 41 is generated. As a result, the gate voltage is reduced to inhibit the main IGBT collector current Ic1 from increasing. That is, the entire system operates in a negative feedback manner with respect to the main IGBT collector current Ic1, thereby limiting the main IGBT collector current Ic1 to a predetermined constant value.

When the main IGBT collector current Ic1 becomes equal to the current limit value at time t5, the gate voltage to the main IGBT 41 is lower and the main IGBT 41 operates in pentode fashion. That is, while the main IGBT collector current Ic1 is flowing, the collector voltage is not sufficiently reduced; Joule loss is being produced in the main IGBT 41.

Also, at this time, with the rise of the collector voltage, the sub IGBT 35 is again activated to cause the sub IGBT collector current Ic2 to flow. Simultaneously, the thyristor structure device 300 also becomes conductive.

The operation when a transient excess voltage surge is caused at time t6 in the power supply voltage due to a load dump or the like will be described. In ordinary cases, the length of time during which the generation of a surge voltage due to a load dump lasts is about 200 msec and longer than assumable ignition intervals (e.g., about 40 msec at 3000 rpm with respect to each cylinder in a four-stroke-cycle engine). That is, the probability that a surge voltage generated at time t6 in the control input signal low-level period is still in an excess voltage state during the time period from time t7 to t8 for the next ignition sequence, as shown in FIG. 4, is high.

When at time t7 the control input signal becomes high level, the sub IGBT 35 is turned on prior to the main IGBT 41 and the thyristor structure device 300 subsequently becomes conductive, as described above.

At this time, the voltage corresponding to the power supply voltage is output as the voltage on the other main terminal of the thyristor structure device 300. However, this voltage is suitably clamped by the above-described clamp means 36, thus enabling prevention of application of an excessively high voltage to the first excess voltage detection circuit 27 in the following stage. When the first excess voltage detection circuit 27 determines that the power supply voltage is excessively high, the first excess voltage detection signal OV1 is output at high level designating an excess voltage state, while the inverted excess voltage signal/OV is output at low level.

The fourth Pch MOS 16 is thereby turned on to stop the second current mirror circuit constituted by the fifth Pch MOS 17 and the sixth Pch MOS 18. As a result, the main IGBT 41 is not turned on in the state where the power supply voltage is excessively high, thus protecting the igniter power semiconductor device 5 from an excess voltage.

After the excess of the power supply voltage has ceased, the system returns to the above-described normal operating condition to continue the ordinary ignition sequence without stopping the internal combustion engine.

First Modified Example of First Embodiment

Figure 6A:
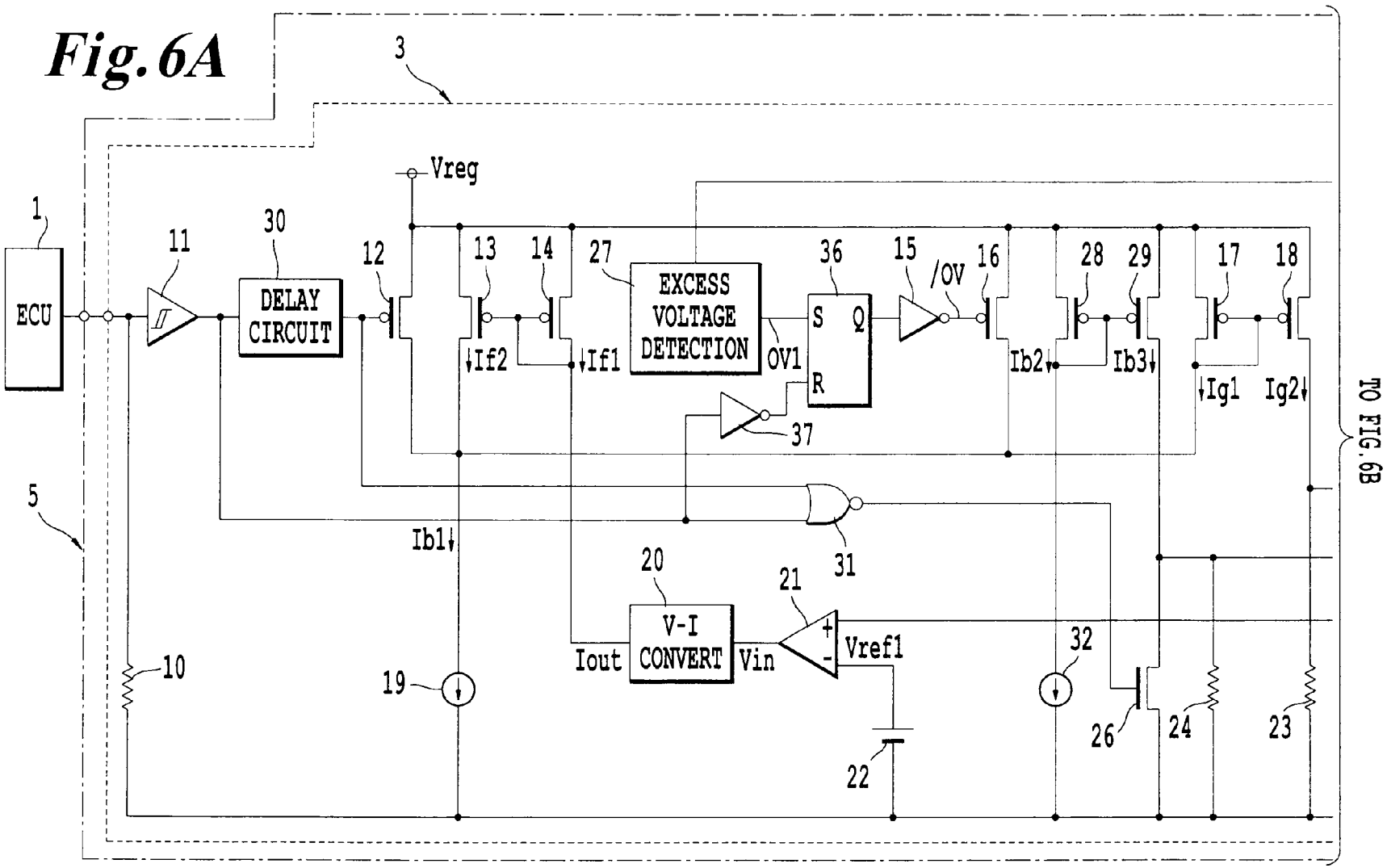
FIG. 6 is a circuit diagram showing an ignition system according to a first modified example of the first embodiment of the present invention.
Figure 6B:
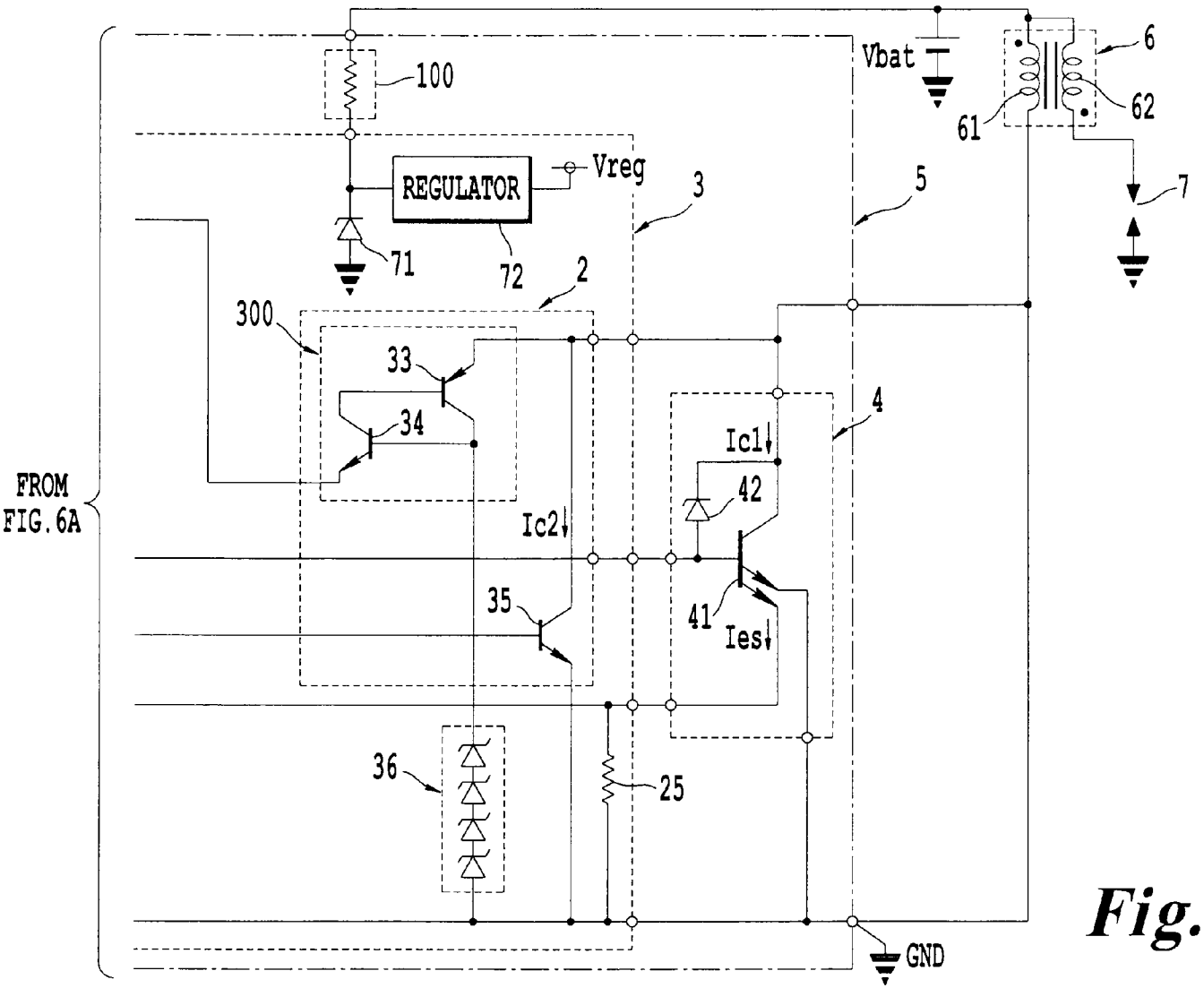

FIG. 6 shows a modified example of the first embodiment of the igniter power semiconductor device according to the present invention. In the figures referred to below, components equivalent in function to those in the first embodiment are indicated by the same reference characters. Description will not be redundantly made for them.

As shown in this modified example, latch means 36 may be provided on the output of the first excess voltage detection circuit 27 to latch and hold the first excess voltage detection signal OV1 until the control input signal becomes low level. Such a modification to the configuration enables the main IGBT 41 to be reliably maintained in the off-state until the next time the control input signal becomes high level, for example, even in a case where the power supply voltage is excessively high during a comparatively short time period such that the power supply voltage again becomes within the normal voltage range before the control input signal becomes low level.

Second Modified Example of First Embodiment

Figure 7A:
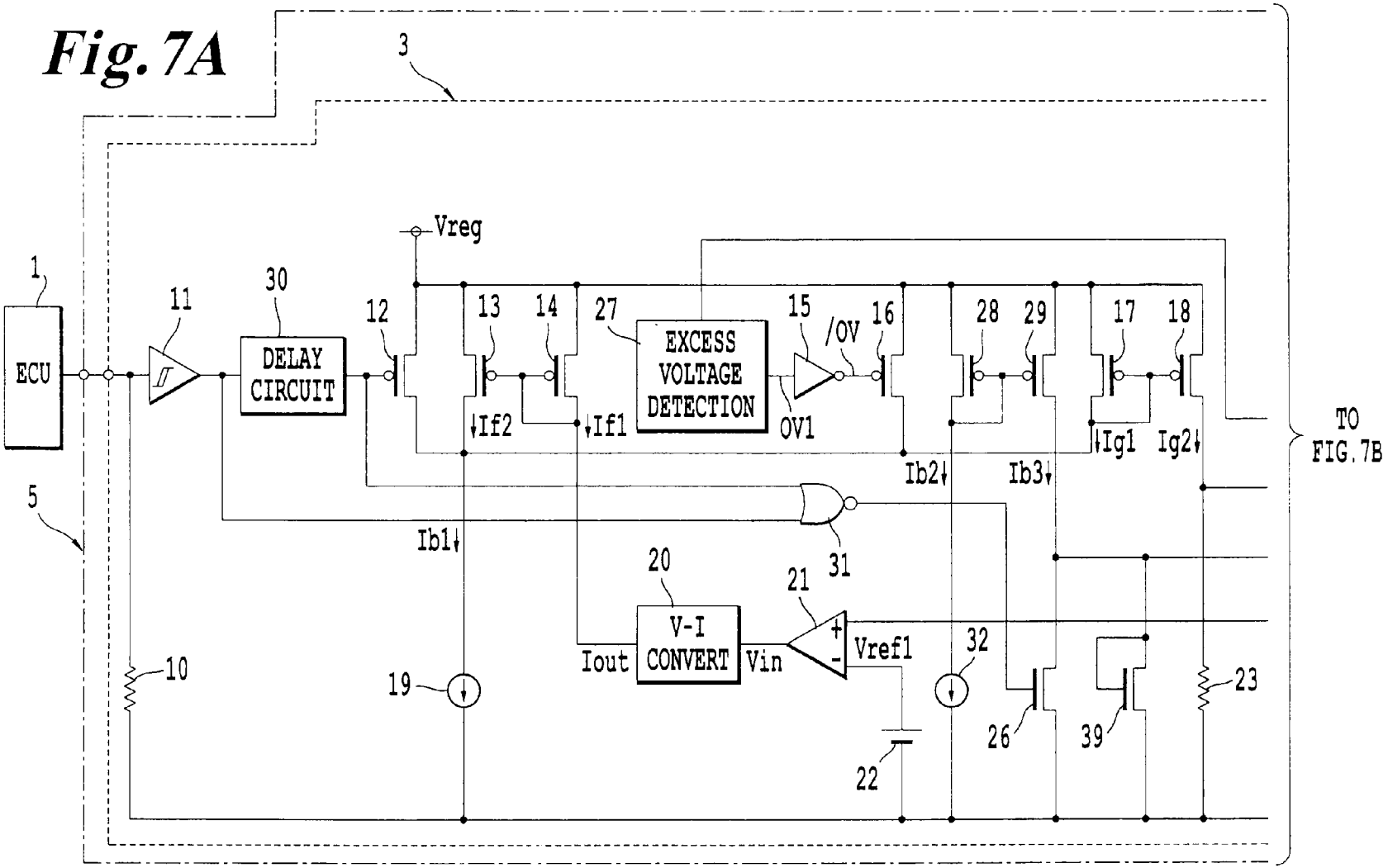
FIG. 7 is a circuit diagram showing an ignition system according to a second modified example of the first embodiment of the present invention.
Figure 7B:
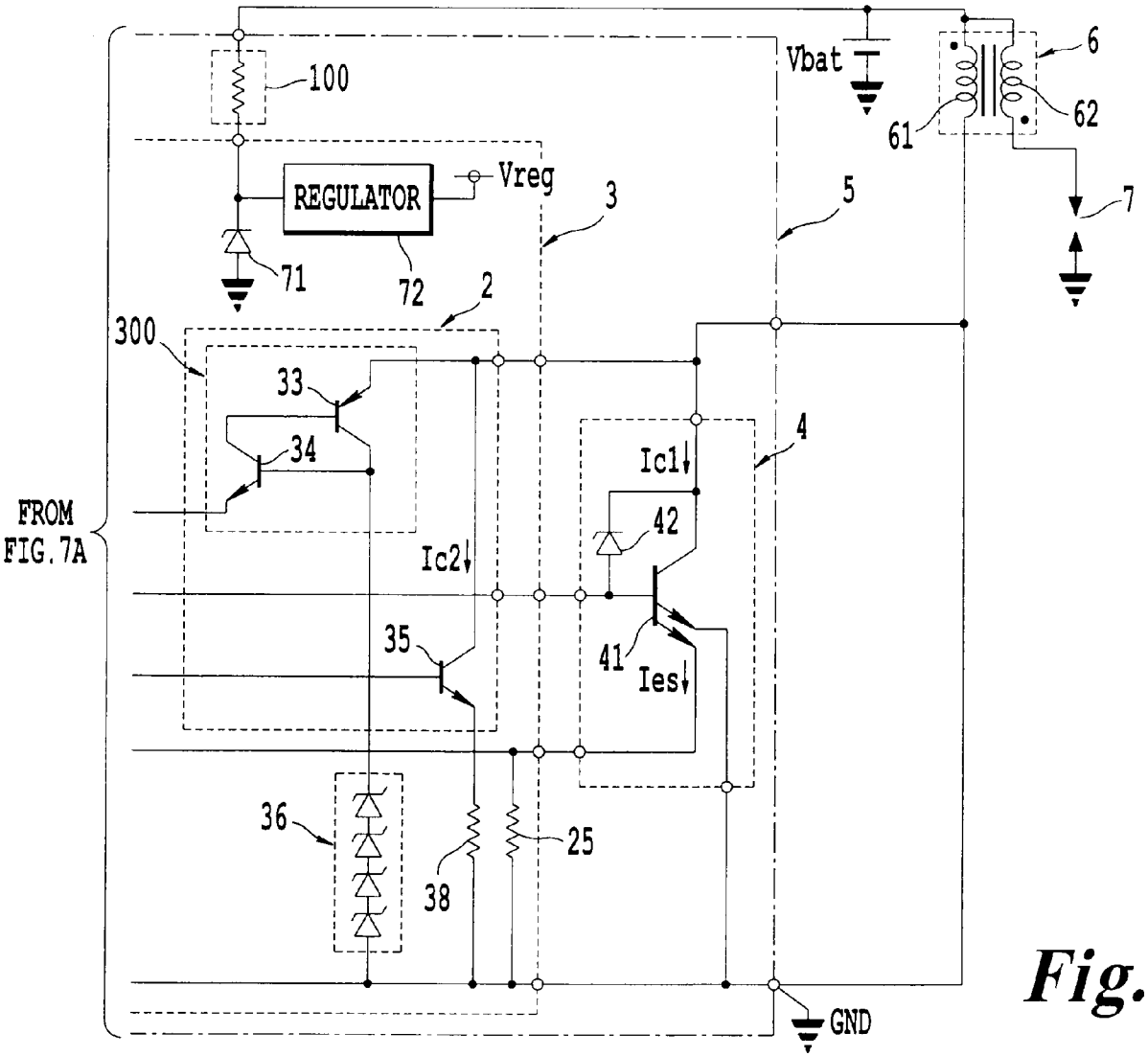

FIG. 7 shows another modified example of the first embodiment of the igniter power semiconductor device according to the present invention. As shown in this modified example, a second Nch MOS 39 diode-connected may be used in place of the first resistor 24 described in the first embodiment as a component for generating the gate drive voltage to the sub IGBT 35. Use of the second Nch MOS 39, a nonlinear element, as a load resistance, enables the gate drive voltage to rise at a higher rate in comparison with the case of the resistance load in the first embodiment, and also enables, by reducing the drive capacity of the second Nch MOS 39, reducing an ineffective part of the load current Ib3 flowing into the reference power supply potential GND. Also, the mount area can be reduced in the case of using the second Nch MOS 39 in comparison with the case of using the first resistor 24 in the first embodiment, thus enabling reducing the chip size of the integrated circuit 3.

Second Embodiment

Figure 8A:
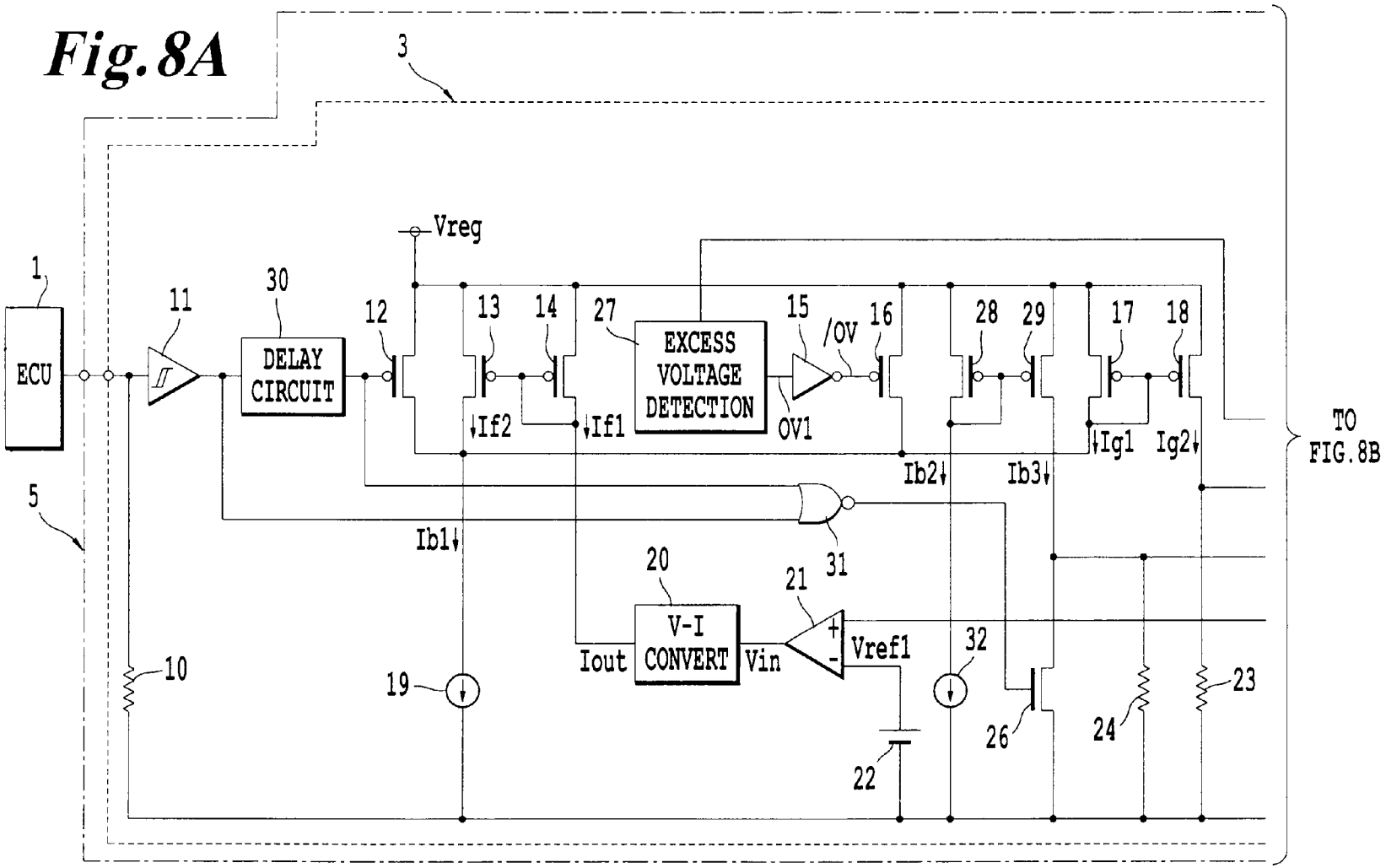
FIG. 8 is a circuit diagram showing an ignition system according to a second embodiment of the present invention.
Figure 8B:
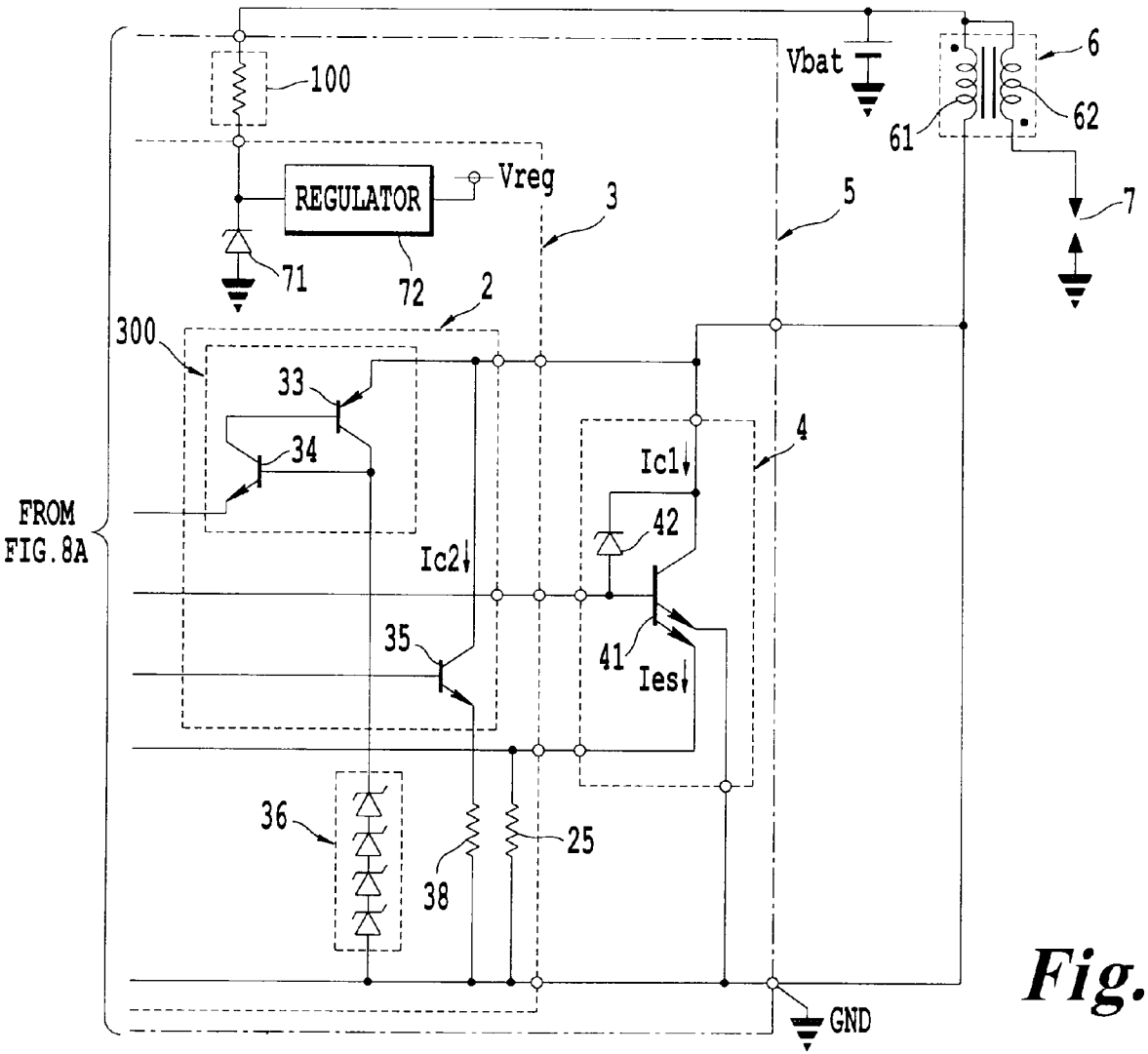

FIG. 8 shows a second embodiment of the igniter power semiconductor device according to the present invention. In the second embodiment, a fourth resistor 38 is provided as current limiting means between the emitter terminal of the sub IGBT 35 and the reference power supply potential GND.

The sub IGBT collector current Ic2 in the first embodiment is rate-determined only by the transistor size of the sub IGBT 35. However, the sub IGBT collector current Ic2 can be stabilized by providing an emitter resistor as in the present embodiment so that negative feedback is performed on the gate-source voltage of the sub IGBT 35.

While in the present embodiment an example of use of a resistance element as current limiting means has been shown, any other means, e.g., an active load such as a current mirror circuit or the above-described diode-connected MOS transistor may alternatively be used. Clamp means such as a Zener diode may be further provided in parallel with the above-described current limiting means.

Third Embodiment

Figure 9A:
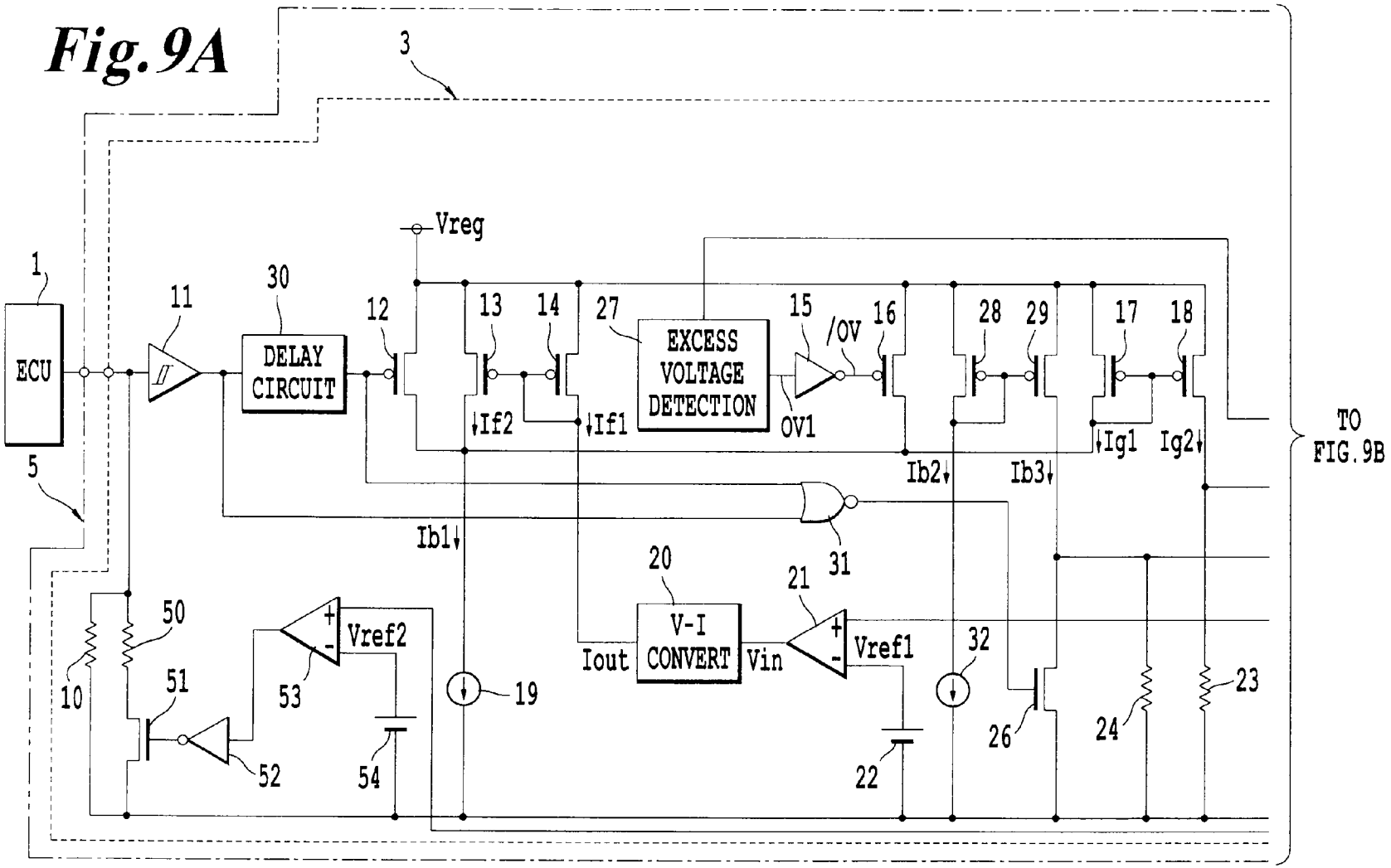
FIG. 9 is a circuit diagram showing an ignition system according to a third embodiment of the present invention.
Figure 9B:
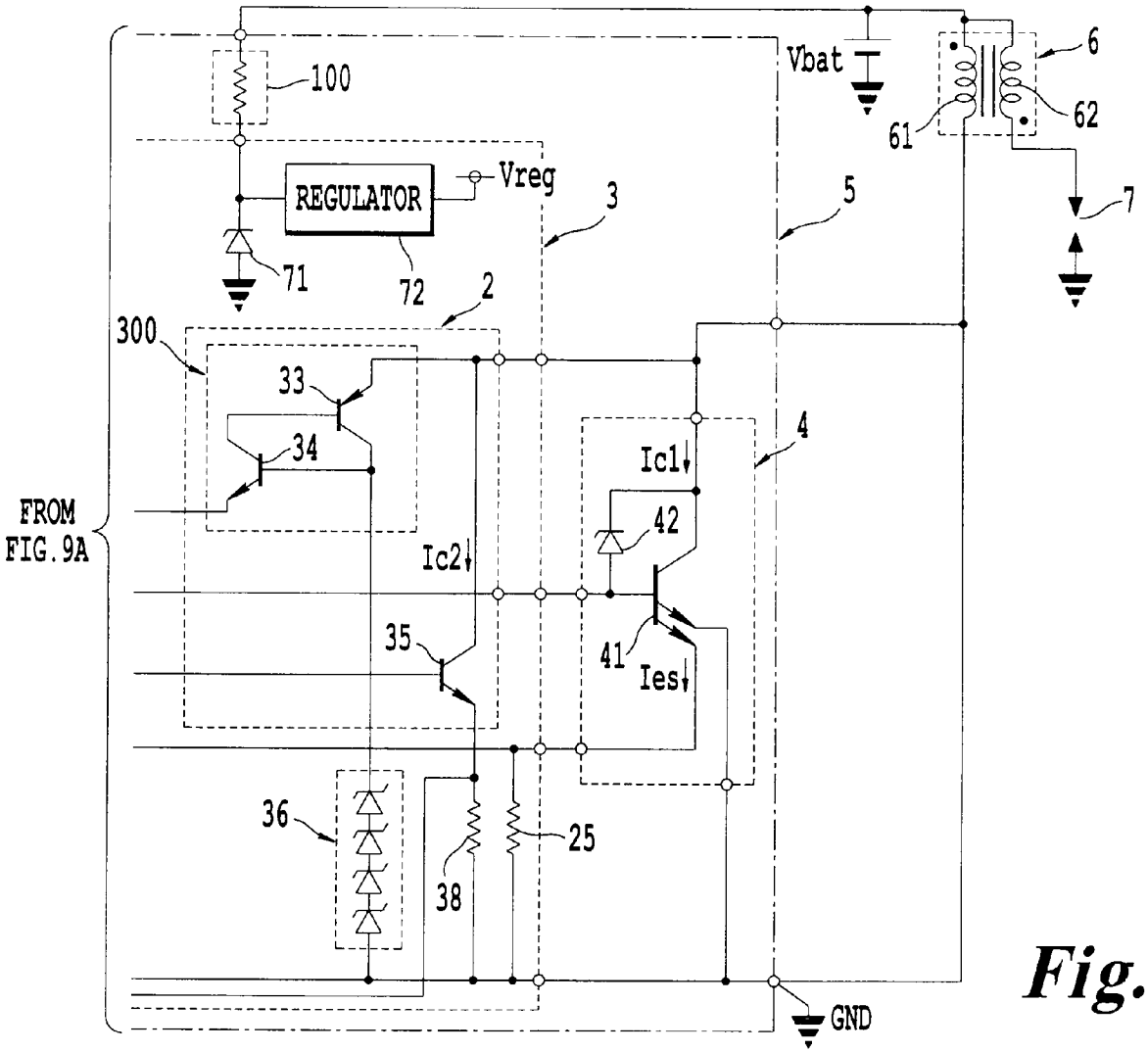

FIG. 9 shows a third embodiment of the igniter power semiconductor device according to the present invention. In the third embodiment, operating condition notification means for detecting a voltage drop generated across the fourth resistor 38, the means for limiting the current through the sub IGBT 35, described in the second embodiment, and for outputting information on the voltage drop to the outside.

When a current flows through the sub IGBT 35, a voltage is generated across the fourth resistor 38 according to the sub IGBT collector current Ic2. This voltage is compared with a voltage Vref2 of a second reference voltage source 54 by a comparator 53. When this voltage is equal to or higher than the voltage Vref2, a third Nch MOS 51 is turned on through a second NOT circuit 52. The input impedance of the integrated circuit 3 as seen from the ECU 1 at this time is the resistance value of a fifth resistor 10 and a sixth resistor 50 in parallel.

When no current is flowing through the sub IGBT 35, the logic is inverted and the third Nch MOS 51 is off. Accordingly, the input impedance is the resistance value of the fifth resistor 10 alone.

That is, the ECU 1 can recognize whether or not a current is flowing through the sub IGBT 35 from a change in the input impedance.

As described above with respect to the first embodiment, a current flows through the sub IGBT 35 during a time period immediately after a start of application of the high-level control input signal and before the main IGBT 41 starts operating, and a current also flows through the sub IGBT 35 when the main IGBT 41 is energized while the gate voltage is being limited by the current limiting function so that the collector voltage is increased.

If information indicating that current limiting is being performed can be transmitted to the ECU 1, it is possible to perform a step such as limiting the increase in temperature of the main IGBT 41 or reducing the power consumption by optimizing the pulse width of the control input signal.

A current flows through the sub IGBT 35 to cause a change in the input impedance not only when the current limiting function is active but also immediately after a start of application of the high-level control input signal, as described above. However, this change occurs in complete synchronization with the control input signal from the ECU 1, can be easily masked on the ECU 1 side and, therefore, does not lead to an erroneous recognition that the current limiting function is active.

Information as to whether or not the current limiting function is active can be detected by some other means. However, a voltage drop generated across the fourth resistor 38, the means for limiting the current through the sub IGBT 35, as in the present embodiment has a large voltage amplitude and is not easily influenced by noise. The system using monitoring of this voltage drop is unsusceptible to a cause of fluctuation such as noise and is capable of making a notification of the activation of the current limiting function while being simple in configuration.

While means for notification to the ECU 1 is realized in the form of a change in input impedance in the present embodiment, the output from the comparator 53 or the value of the voltage drop across the fourth resistor 38 may be directly output if there are spare terminals in the input port of the ECU 1 and the terminals of the igniter power semiconductor device 5.

Fourth Embodiment

Figure 10A:
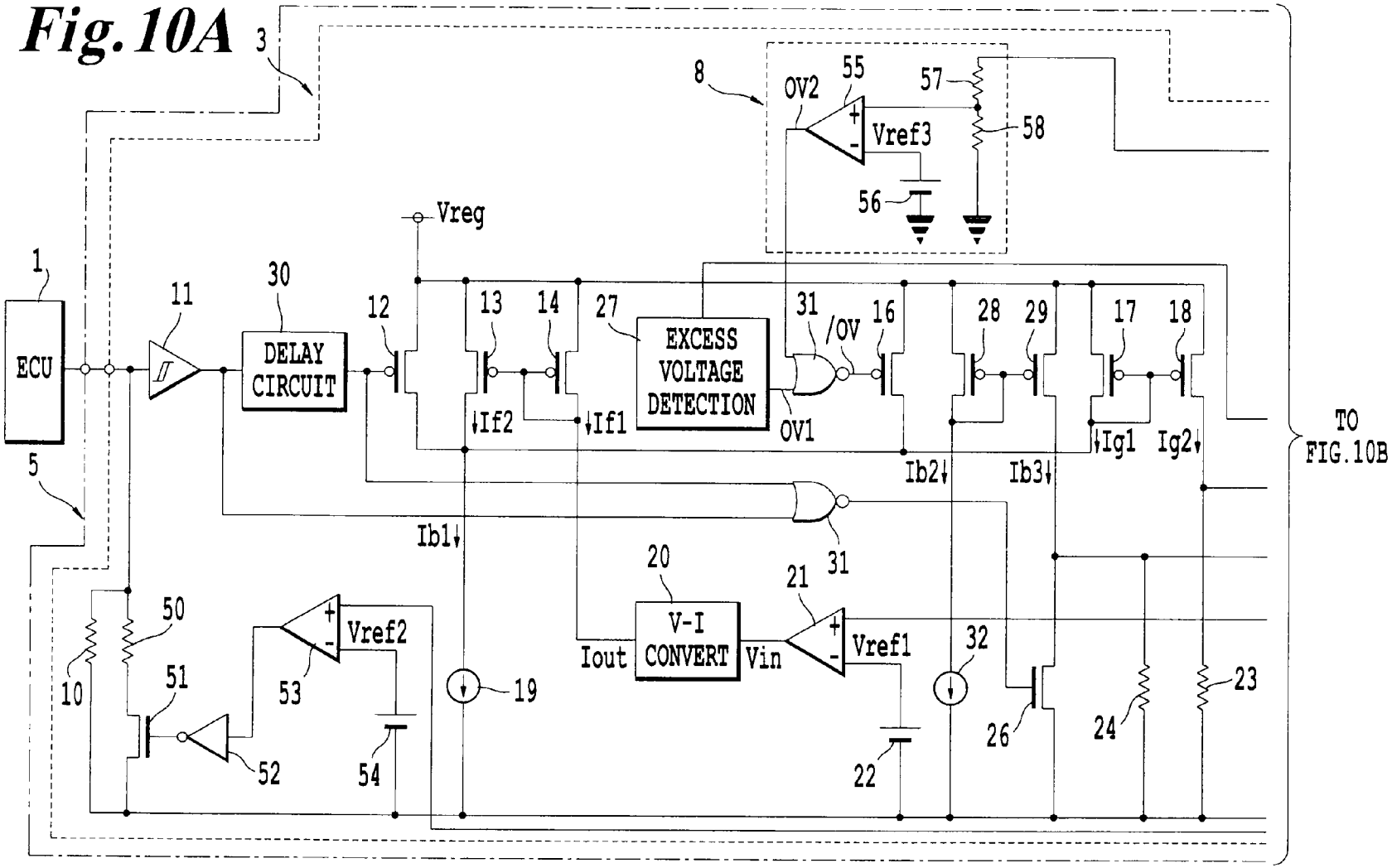
FIG. 10 is a circuit diagram showing an ignition system according to a fourth embodiment of the present invention.
Figure 10B:
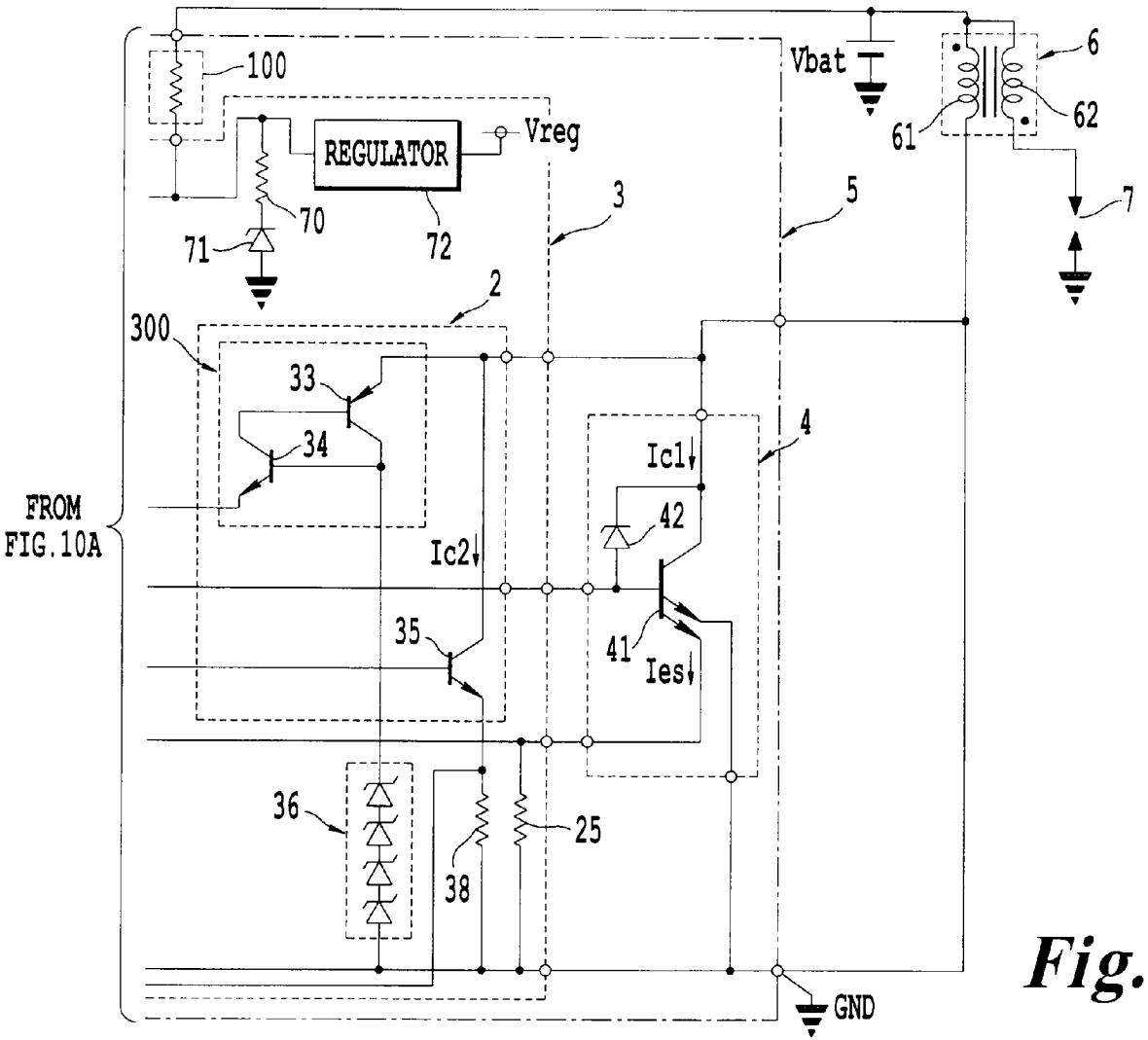

FIG. 10 shows a fourth embodiment of the igniter power semiconductor device according to the present invention. In the fourth embodiment, second excess voltage detection circuit 8 for directly observing the power supply voltage is provided in addition to the first excess voltage detection circuit 27 for observing the collector voltage on the main IGBT 41.

The first excess voltage detection circuit 27 can detect only an excess voltage generated in a time period of several tens of microseconds through which the energization of the main IGBT 41 is delayed by the delay circuit 30 immediately after a transition of the control input signal to high level. As described above in the description of the first embodiment, an excess voltage of the power supply due to a load dump or the like lasts for about 200 milliseconds, while ignition intervals assumable with respect to an ordinary four-stroke-cycle engine is about several ten milliseconds. Therefore, even if a power supply excess voltage is generated in the main IGBT 41 energization period (ordinarily about several milliseconds) during which the excess voltage detection circuit 27 cannot detect the excess voltage, which is a rare case, the main IGBT 41 is shut off at the next ignition time. Therefore, there is ordinarily no problem with such a case.

However, if there is a need to reliably shut off the main IGBT 41 immediately after the generation of an excess voltage in a rare case such as described above, the second excess voltage detection circuit 8 for directly monitoring the power supply voltage may be provided as in the present embodiment.

Referring to FIG. 10, the power supply voltage Vbat is input to a regulator 72, which is a constant-voltage circuit on the integrated circuit 3, via a seventh resistor 100 mounted on the igniter power semiconductor device 5. The voltage input to the regulator 72 is clamped with a Zener diode 71. However, the clamping ability is reduced by connecting an eighth resistor 70 in series to secure sensitivity at the time of input of an excess voltage. It is desirable to limit the resistance value of the eighth resistor 70 to about 1/10 or less of the resistance value of the seventh resistor 100 in order to limit Joule loss at the time of input of an excess voltage.

In the second excess voltage detection circuit 8, the input voltage to the regulator 72 is divided by a ninth resistor 57 and a tenth resistor 58, then input to a second comparator 55 to be compared with a voltage value Vref3 of a third reference voltage 56.

A second excess voltage detection signal OV2 output from the second excess voltage detection circuit 8 is input to a second NOR circuit 31 along with the first excess voltage detection signal OV1. By an output from the second NOR circuit 31, the fourth Pch MOS 16 is driven.

The second excess voltage detection circuit 8 has its sensitivity secured by the eighth resistor 70, but its excess voltage detection sensitivity is not high since the input voltage is clamped with the Zener diode 71. In order to prevent a detection error, therefore, it is desirable to set an excess voltage detection value Vov2 in the second excess voltage detection circuit 8 larger than an excess voltage detection value Vov1 in the first excess voltage detection circuit 27.

Figure 11:
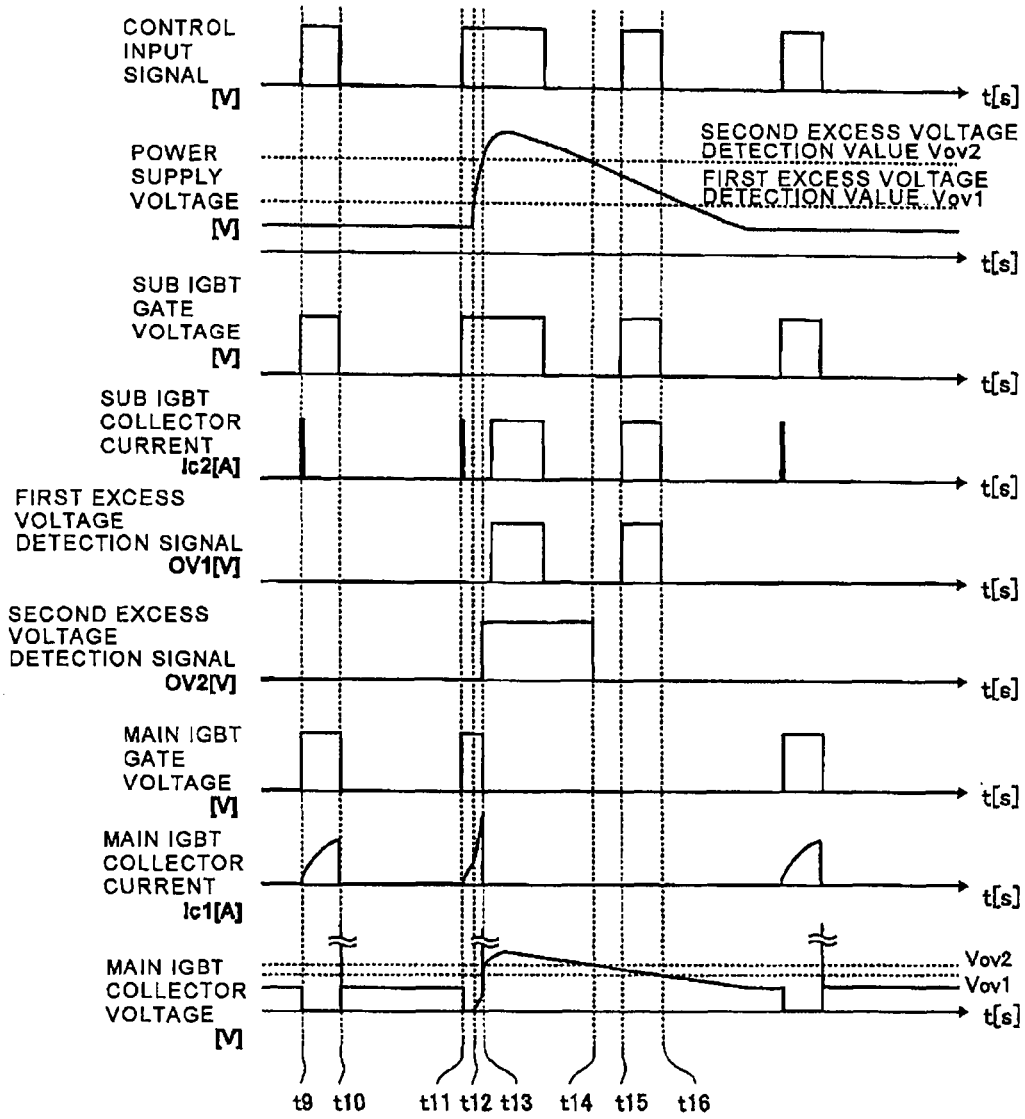
FIG. 11 is a timing chart for illustrating the operation of the ignition system according to the fourth embodiment of the present invention.

The operation in the present embodiment will be described with reference to FIG. 11. A situation is considered in which an excess voltage is generated in the power supply voltage at or after time t12 at which energization of the main IGBT 41 is started after a lapse of time corresponding to the delay time of the delay circuit 30 from time t11 at which the control input signal is input.

In this situation, the first excess voltage detection circuit 27 does not output the first excess voltage detection signal OV1 since the sub IGBT 35 and the thyristor structure device 300 are shut off. At time t13 at which the power supply voltage becomes equal to the second excess voltage detection value Vov2, the second excess voltage detection signal OV2 is output.

The inverted excess voltage detection signal/OV is thereby made low level to turn on the fourth Pch MOS 16, thereby shutting off the main IGBT 41. By this shutoff, the collector voltage on the main IGBT 41 is increased to reactivate the sub IGBT 35 and the thyristor structure device 300, and the first excess voltage detection circuit 27 starts outputting the first excess voltage detection signal OV1.

When at time t14 the power supply voltage becomes lower than the second excess voltage detection value Vov2, output of the second excess voltage detection signal OV2 is stopped. At time t15 corresponding to the next ignition time, because the power supply voltage is still higher than the first excess voltage detection value Vov1 as described above, the first excess voltage detection circuit 27 suitably maintains the main IGBT 41 in the shut-off state.

Obviously many modifications and variations of the present invention are possible in the light of the above teachings. It is therefore to be understood that within the scope of the appended claims the invention may be practiced otherwise than as specifically described.

The entire disclosure of a Japanese Patent Application No. 2009-284098, filed on Dec. 15, 2009 including specification, claims, drawings and summary, on which the Convention priority of the present application is based, are incorporated herein by reference in its entirety.

What is claimed is:

1. A power semiconductor device for an igniter comprising:

a first semiconductor switching device causing a current to flow through a primary side of an ignition coil or shutting off the current flowing through the primary side of the ignition coil; and an integrated circuit driving and controlling the first semiconductor switching device, wherein the integrated circuit includes:

a second semiconductor switching device connected in parallel with the first semiconductor switching device and having a smaller current capacity than a current capacity of the first semiconductor switching device;

a delay circuit delaying a first control input signal to generate a second control input signal;

a first drive circuit driving the first semiconductor switching device according to the second control input signal;

a second drive circuit driving the second semiconductor switching device according to the first control input signal;

a third semiconductor switching device including a thyristor structure having a main terminal connected to a high voltage side main terminal of the second semiconductor switching device, the thyristor structure being made conductive by a part of a main current flowing through the energized second semiconductor switching device;

a first excess voltage detection circuit monitoring voltage on the high voltage side main terminal of the second semiconductor switching device by monitoring conduction of the third semiconductor switching device and controlling the first drive circuit to stop the first semiconductor switching device without stopping the second semiconductor switching device when the voltage is equal to or more than a predetermined voltage.

2. The power semiconductor device for an igniter according to claim 1, wherein the second semiconductor switching device includes a current-limiting circuit connected between a low voltage side main terminal and a reference power supply potential.

3. The power semiconductor device for an igniter according to claim 2, further comprising an operating condition notification circuit outputting a signal according to a voltage drop generated across the current-limiting circuit when the second semiconductor switching device is energized so as to notify an operating condition of the integrated circuit.

4. The power semiconductor device for an igniter according to claim 1, further comprising a second excess voltage detection circuit monitoring a main power supply voltage and stopping the first semiconductor switching device when the main power supply voltage is equal to or more than the predetermined voltage.

* * * * *